US008550501B2

(12) United States Patent
Pyeon et al.

(10) Patent No.: US 8,550,501 B2
(45) Date of Patent: Oct. 8, 2013

(54) WIRE-BOUND PRODUCT AND METHOD FOR MANUFACTURING THE SAME

(76) Inventors: Jun Gyu Pyeon, Seoul (KR); Hyun Lee, Seoul (KR)

( * ) Notice: Subject to any disclaimer, the term of this patent is extended or adjusted under 35 U.S.C. 154(b) by 257 days.

(21) Appl. No.: 12/939,409

(22) Filed: Nov. 4, 2010

(65) Prior Publication Data

US 2011/0101668 A1 May 5, 2011

(30) Foreign Application Priority Data

Nov. 4, 2009 (KR) ..... 10-2009-0106021

(51) Int. Cl.

| | |
|---|---|
| ***B42D 3/00*** | (2006.01) |
| ***B42D 1/00*** | (2006.01) |
| ***B42F 3/00*** | (2006.01) |
| ***B42F 13/40*** | (2006.01) |
| ***B42F 3/06*** | (2006.01) |
| ***B42F 13/04*** | (2006.01) |
| ***B42C 9/00*** | (2006.01) |
| ***B42B 5/08*** | (2006.01) |
| ***B42B 5/00*** | (2006.01) |
| ***B42B 5/06*** | (2006.01) |
| ***B42B 5/10*** | (2006.01) |
| ***B42B 9/00*** | (2006.01) |

(52) U.S. Cl.

USPC ..... 281/33; 281/3.1; 281/15.1; 402/4; 402/57; 412/6; 412/7; 412/9; 412/33; 412/34; 412/39; 412/40

(58) Field of Classification Search

USPC ..... 281/2, 3.1, 15.1, 33; 283/106; 402/4, 402/57, 80 P; 412/1, 6, 7, 9, 33, 34, 39, 40

See application file for complete search history.

(56) References Cited

U.S. PATENT DOCUMENTS

| | | | | |
|---|---|---|---|---|
| 2,258,273 | A * | 10/1941 | Barrett | 281/33 |
| 4,711,469 | A * | 12/1987 | Bogar | 281/15.1 |
| 5,062,229 | A | 11/1991 | Werjefelt | |
| 2008/0290651 | A1 * | 11/2008 | Kruchko et al. | 283/106 |
| 2010/0150682 | A1 * | 6/2010 | Klassen et al. | 412/33 |

FOREIGN PATENT DOCUMENTS

| | | | |
|---|---|---|---|
| JP | 2005-131792 | A | 5/2005 |
| KR | 20-0391114 | Y1 | 8/2005 |
| KR | 20-0432524 | Y1 | 12/2006 |

OTHER PUBLICATIONS

Korean Intellectual Property Office, Written Opinion of the International Searching Authority for International Application No. PCT/KR2010/007767, Jul. 14, 2011.

Korean Intellectual Property Office, International Search Report for International Application No. PCT/KR2010/007767, Jul. 14, 2011.

* cited by examiner

*Primary Examiner* — Dana Ross
*Assistant Examiner* — Justin V Lewis
(74) *Attorney, Agent, or Firm* — Sherr & Jiang, PLLC

(57) ABSTRACT

A wire-bound product using a double type laminated paper board and a method for manufacturing the same are disclosed. The wire-bound product employs a structure in which inner paper sheets are turned over in the rightward and leftward directions on front plates of a frame, instead a structure in which a plurality of inner paper sheets is turned over toward the rear surface of a frame, thereby allowing a user to see both surfaces of the inner paper sheets. Further, rear plates of the frame are inserted into various positions of a spring to support the front plates, thereby allowing a standing angle of the front plates of the frame to be adjustable.

5 Claims, 14 Drawing Sheets

WIRE-BOUND PRODUCT AND METHOD FOR MANUFACTURING THE SAME

This application claims the benefit of Korean Patent Application No. 10-2009-0106021, filed on Nov. 4, 2009, which is hereby incorporated by reference as if fully set forth herein.

BACKGROUND OF THE INVENTION

1. Field of the Invention

The present invention relates to a wire-bound product, such as a desk calendar, and a method for manufacturing the same.

2. Discussion of the Related Art

In general, calendars are charts on which months, days, and 24 divisions in the lunar cycle, and events for 1 year are drawn so as to be used in daily life, religious ceremonies or for historical and scientific purposes.

Calendars are divided into wall calendars used in a hanging state on walls and desk calendars used in a standing state on desks.

A conventional desk calendar has a structure in which a plurality of paper sheets is connected to a frame using a connection unit, such as a spring, and many wire-bound products, such as the desk calendar, have been placed on the market.

Each of the conventional wire-bound products, such the desk calendar, includes a frame standing on a table, a plurality of paper sheets, and a spring to connect the frame and the plurality of paper sheets.

For example, a desk calendar includes a frame standing on a table, a plurality of calendar paper sheets, i.e., 12 calendar paper sheets respectively stating 12 months, and a spring to connect the frame and the calendar paper sheets.

The frame is formed in a triangular shape including a front plate, a rear plate, and a bottom plate.

The plural calendar paper sheets, on which date information of the respective months are printed, are disposed on the front surface of the front plate of the frame. In general, the date information is printed on the front surfaces of the respective paper sheets, and designs or advertisements are printed on the rear surfaces of the respective paper sheets.

A connection unit, such as the spring, connects the plural calendar paper sheets so as to allow the plural calendar paper sheets to be turned over one by one as well as to prevent the plural calendar paper sheets from being separated.

The conventional desk calendar further includes an adhesive unit to adhere the calendar paper sheets, connected by the connection unit, to the front surface of the front plate of the frame.

The conventional desk calendar is manufactured with four pieces of a laminated paper board, i.e., the front plate, the rear plate, and the two bottom plates, thus having high manufacturing costs.

Further, the conventional desk calendar is configured such that the calendar paper sheets are turned over rearward, thus placing advertisements only on a single surface of each of the calendar paper sheets. That is, a user can see date information printed on the front surface of the paper sheet but cannot see designs or advertisements printed on the rear surface of the paper sheet. Further, since the designs or the advertisements printed on the rear surface of the paper sheet are located on the rear portion of the frame after the paper sheet is turned over rearward, in order to see the designs or the advertisements, the user must turn the frame around. Further, in this case, the user cannot see date information printed on the front surface of the paper sheet.

First of all, the frame is formed in the fixed triangular structure, and thus it is difficult to adjust an eye level of the calendar according to user's taste.

SUMMARY OF THE INVENTION

Accordingly, the present invention is directed to a wire-bound product and a method for manufacturing the same.

An object of the present invention is to provide a wire-bound product, which employs a structure in which inner paper sheets are turned over in the rightward and leftward directions on front plates of a frame, instead of a structure in which a plurality of inner paper sheets is turned over toward the rear surface of a frame, so as to allow a user to see both surfaces of the inner paper sheets, and a method for manufacturing the wire-bound product.

Another object of the present invention is to provide a wire-bound product, in which rear plates of a frame are inserted into various positions of a spring so as to allow a standing angle of front plates of the frame to be adjustable, and a method for manufacturing the wire-bound product.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a wire-bound product includes a laminated paper board including first and second folded parts provided in the horizontal direction and spring insertion holes provided at the center in the vertical direction, a wire-bound spring coupled with the spring insertion holes, and a plurality of inner paper sheets, each of which is provided with one side connected to the wire-bound spring.

In another aspect of the present invention, a wire-bound product includes a laminated paper board including a first laminated paper piece with first and second folded parts provided in the horizontal direction, a second laminated paper piece with third and fourth folded parts provided in the horizontal direction in parallel with the first and second folded parts, and spring insertion holes provided through a part of the upper region of a connection portion between the first and second laminated paper pieces in the vertical direction, a spring coupled with the spring insertion holes, and paper sheets, each of which is provided with one side connected to the spring, rotated rightward and leftward about the spring, wherein the first and second laminated paper pieces of the laminated paper board are divided into upper laminated paper pieces with the spring and lower laminated paper pieces with the second and fourth folded parts by the first and third folded parts running in parallel, and the lower laminated paper pieces are divided into first lower laminated paper pieces and second lower laminated paper pieces by the second and fourth folded parts running in parallel, and, as the laminated paper board is folded at a designated first folded angle by the first and third folded parts and is then folded at a designated second folded angle by the second and fourth folded parts, the lower ends of the second lower laminated paper pieces corresponding to the lower end of the laminated paper board are inserted into a designated pitch of a plurality of pitches of the spring.

In a further aspect of the present invention, a method for manufacturing a wire-bound product includes forming first and second folded parts on a first laminated paper piece in the horizontal direction, forming third and fourth folded parts on a second laminated paper piece in the horizontal direction, completing a laminated paper board by arranging side portions of the first laminated paper piece and the second laminated paper piece such that the first folded part of the first laminated paper piece and the third folded part of the second laminated paper piece run in parallel and the second folded part of the first laminated paper piece and the fourth folded part of the second laminated paper piece run in parallel and then adhering a cover sheet to the front or rear surfaces of the first laminated paper piece and the second laminated paper piece, folding the laminated paper board in one direction along the connected side portions of the first and second laminated paper pieces, and forming spring insertion holes in parallel in the vertical direction at a position of the laminated paper board adjacent to the folded portion of the laminated paper board, coupling a spring with the spring insertion holes and inserting a plurality of inner paper sheets into the spring, completing a semi-finished product including the inner paper sheets, the spring and the laminated paper board by cutting ends of the spring and contracting expanded parts of the cut ends, simultaneously, forming bottom plates by folding the first folded part and the third folded part, running in parallel, in the rearward direction of the semi-finished product, and completing a finished product by folding the second folded part and the fourth folded part, running in parallel, at a designated folded angle with respect to the bottom plates and inserting the lower ends of the first and second laminated paper pieces into a designated pitch of a plurality of pitches of the spring.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The present invention exemplarily describes a desk calendar as a wire-bound product. However, the present invention is not limited to the calendar, and may be applied to a publication or stationary using a product structure of calendar, which will be described hereinafter, must be understood as an example of the wire-bound product.

Figure 1:
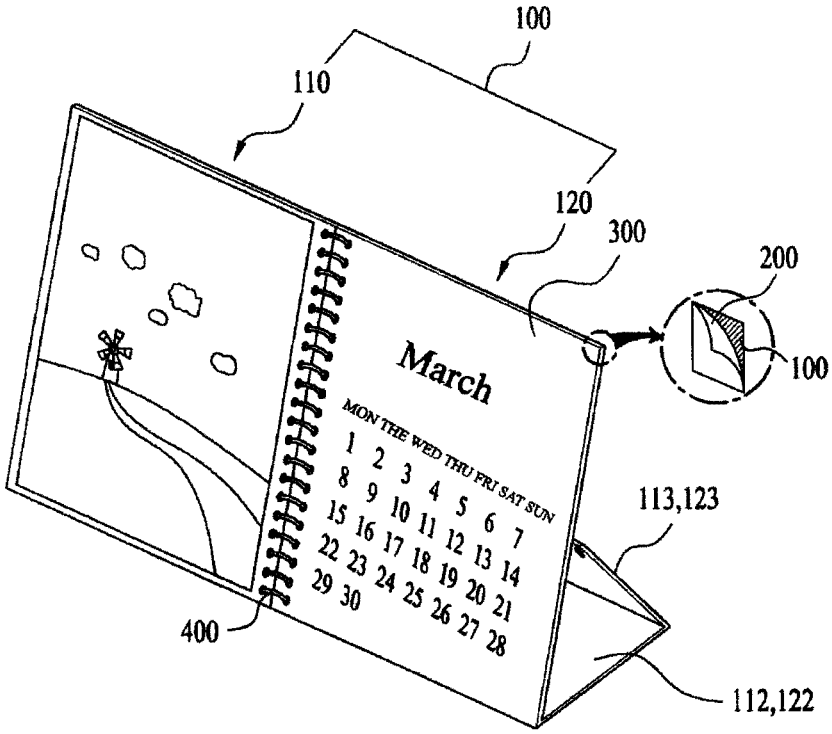
FIG. 1 is a perspective view illustrating a double-sided desk calendar with an adjustable tilt angle, at which front plates of a frame stand, in accordance with the present invention.
Figure 2:
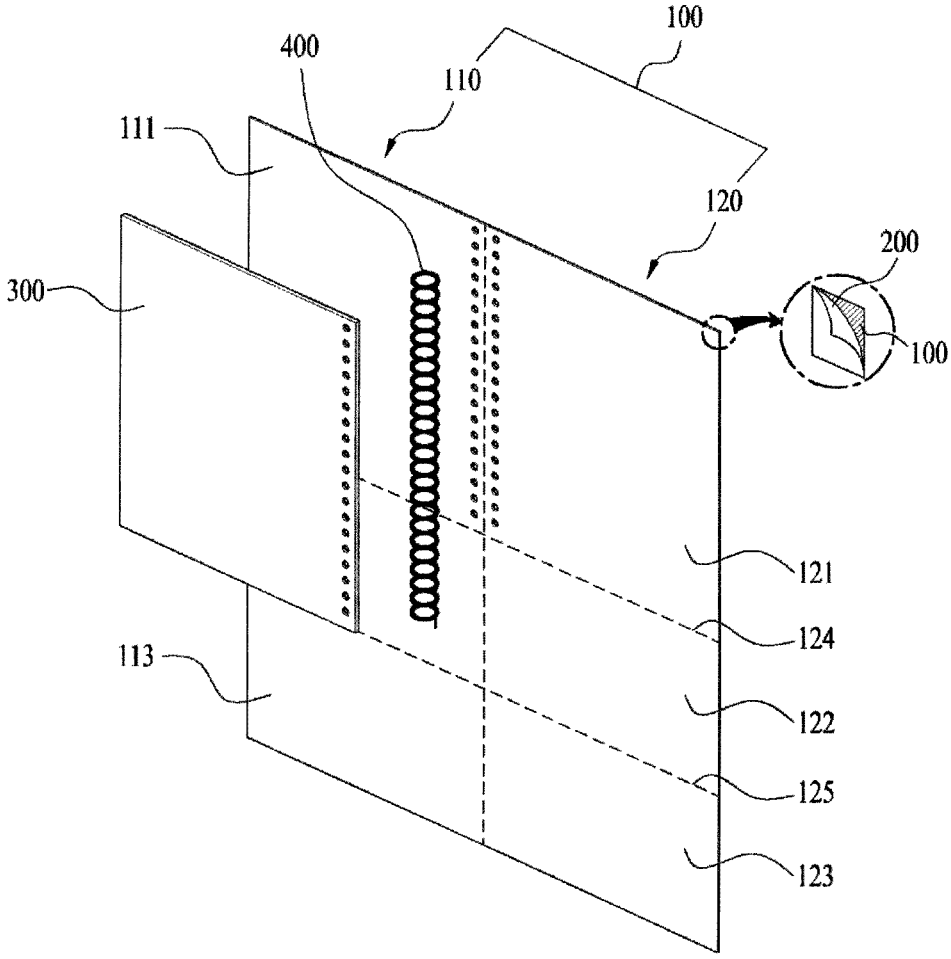
FIG. 2 is an exploded perspective view of the double-sided desk calendar in accordance with the present invention.

FIG. 1 is a perspective view illustrating a double-sided desk calendar with an adjustable tilt angle, at which front plates of a frame stand, in accordance with the present invention, and FIG. 2 is an exploded perspective view of the double-sided desk calendar in accordance with the present invention.

The double-sided desk calendar in accordance with the present invention includes a laminated paper board 100, a cover sheet 200, a spring 400, and calendar inner paper sheets 300.

First, the laminated paper board 100 in accordance with the present invention will be described. The laminated paper board 100 in accordance with the present invention is formed by connecting two rectangular laminated paper pieces in parallel, and is thus referred to as a double type laminated paper board. The two laminated paper pieces of the double type laminated paper board 100 include a first laminated paper piece 110 and a second laminated paper piece 120. That is, the double type laminated paper board 100 includes the first laminated paper piece 110 and the second laminated paper piece 120. Hereinafter, the first laminated paper piece 110 and the second laminated paper piece 120 will be described as being in a standing state in which the vertical length of each of the first and second laminated paper pieces 110 and 120 is greater than the horizontal length of each of the first and second laminated paper pieces 110 and 120.

The first laminated paper piece 110 includes first and second folded parts 114 and 115 formed in the horizontal direction.

The second laminated paper piece 120 includes third and fourth folded parts 214 and 215 formed in the horizontal direction.

When one side portion of the first laminated paper piece 110 and one side portion of the second laminated paper piece 120 are connected in parallel, the first and second folded parts 114 and 115 and the third and fourth folded parts 124 and 125 are arranged in parallel in the horizontal direction.

In order to connect the side portions of the first laminated paper piece 110 and the second laminated paper piece 120, the side portions of the first laminated paper piece 110 and the second laminated paper piece 120 are arranged adjacent to each other, and then the cover sheet 200 is adhered to one surface of each of the first and second laminated paper pieces 110 and 120, thereby completing the double type laminated paper board 100. For example, the cover sheet 200 made of paper, fabric, or vinyl is adhered to the front surfaces or the rear surfaces of the first laminated paper piece 110 and the second laminated paper piece 120. The cover sheet 200 serves as a hinge to allow the first laminated paper piece 110 and the second laminated paper piece 120 to move around the connection portion therebetween and serves as a hinge to allow the first folded part 114 to move together with the third folded part 124 and to allow the second folded part 115 to move together with the fourth folded part 125.

The double type laminated paper board 100 further includes spring insertion holes prepared in plural pairs. The spring insertion holes are provided in the vertical direction at a part of the upper region of the connection portion between the first laminated paper piece 110 and the second laminated paper piece 120 of the double type laminated paper board 100. A detailed description of formation of the spring insertion holes will be described with reference FIG. 6.

The desk calendar in accordance with the present invention includes the spring 400 inserted into the spring insertion holes, and the calendar inner paper sheets 300, each of which is provided with one side connected to the spring 400 and is rotated rightward and leftward about the spring 400.

The double type laminated paper board 100 supports the spring 400 connected with the calendar inner paper sheets 300 while supporting the calendar inner paper sheets 300.

The double type laminated paper board 100 is divided into upper laminated paper pieces and lower laminated paper pieces by the first and third folded parts 114 and 124 arranged in parallel. Then, the lower laminated paper pieces are divided into first lower laminated paper pieces and second lower laminated paper pieces by the second and fourth folded parts 115 and 125 arranged in parallel. Hereinafter, the upper laminated paper pieces will be described as front plates 111 and 121, the first lower laminated paper pieces will be described as bottom plates 112 and 122, and the second lower laminated paper pieces will be described as rear plates 113 and 123.

The double type laminated paper board 100 is folded in the rearward direction at the first and third folded parts 114 and 124, and is again folded at the second and fourth folded parts 115 and 125, thereby forming the desk calendar including the front plates 111 and 121, the bottom plates 112 and 122, and the rear plates 113 and 123 supporting the front plates 111 and 121 corresponding to the upper laminated paper pieces, as shown in FIG. 1.

The front plates 111 and 121 include a left front plate 111 and a right front plate 121, the bottom plates 112 and 122 include a left bottom plate 112 and a right bottom plate 122, and the rear plates 113 and 123 include a left rear plate 113 and a right rear plate 123.

In more detail, the double type laminated paper board 100 is folded at a designated first folded angle by the first and third folded parts 114 and 124, and is again folded at a designated second folded angle by the second and fourth folded parts 115 and 125. Thereby, the lower ends of the rear plates 113 and 123 corresponding to the lower end of the double type laminated paper board 100 are inserted into a designated pitch of a plurality of pitches of the spring 400, thus supporting the front plates 111 and 121.

The rear plates 113 and 123 support the front plates 111 and 121 and the lower ends of the rear plates 113 and 123 are inserted into any pitch of the plural pitches of the spring 400, and thus the rear plates 113 and 123 serve to adjust an eye level. That is, as the lower ends of the rear plates 113 and 123 are inserted into different pitches of the plural pitches of the spring 400, the front plates 111 and 121 have different tilt angles with respect to the bottom plates 112 and 122.

Further, in order to obtain the structure of the desk calendar, as shown in FIG. 1, the first folded angle formed by the first and third folded parts 114 and 124 may be 20~179° in the rearward direction with respect to the front plates 111 and 121, and the second folded angle formed by the second and fourth folded parts 115 and 125 may be 20~179° in the direction to the front plates 111 and 121 from the bottom plates 112 and 122.

In the structure of the double type laminated paper board 100 folded at the designated first folded angle by the first and third folded parts 114 and 124 and then folded at the designated second folded angle by the second and fourth folded parts 115 and 125, at least two folded parts are provided in parallel in the horizontal direction, and another folded part is provided at the center of the vertical direction. Further, the spring insertion holes are provided at the center of the vertical direction. The spring insertion holes are preferably located at the center of the connection portion between the front plates 111 and 121. Here, one of the at least two folded parts provided in parallel in the horizontal direction corresponds to the first and third folded parts 114 and 124, and the other of the at least two folded parts corresponds to the second and fourth folded part 115 and 125. The folded part in the vertical direction corresponds to the connection portion between the first laminated paper piece 110 and the second laminated paper piece 120.

Figure 6:
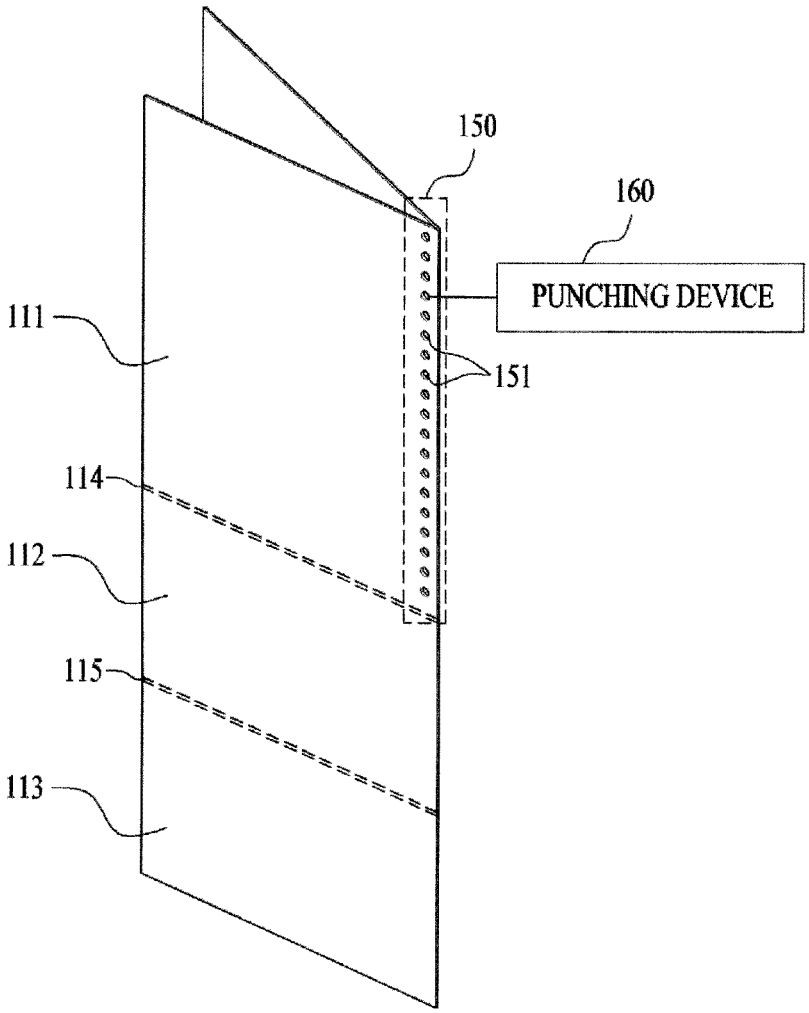
FIG. 6 is a perspective view exemplarily illustrating spring insertion holes formed in parallel in the vertical direction through a double type laminated paper board in accordance with the present invention.

Preferably, the first and third folded parts 114 and 124 and the second and fourth folded parts 115 and 125 are folded in the rearward direction with respect to the front plates 111 and 121, and the folded part corresponding to the connection portion between the first laminated paper piece 110 and the second laminated paper piece 120 is folded in the forward direction, as shown in FIG. 6. That is, the folded direction of the first and third folded parts 114 and 124 and the second and fourth folded parts 115 and 125 and the folded direction of the folded part corresponding to the connection portion between the first and second laminated paper pieces 110 and 120 are preferably opposite to each other.

The first and third folded parts 114 and 124 are provided at the center of the entire surface of the double type laminated paper board 100 in the horizontal direction, i.e., at a position located two-fourths of the way from the upper end of the double type laminated paper board 100 in the vertical direction.

The second and fourth folded parts 115 and 125 are provided at the centers of the lower laminated paper pieces, obtained by dividing the double type laminated paper board 100 by the first and third folded parts 114 and 124, in the horizontal direction, i.e., at a position located three-fourths of the way from the upper end of the double type laminated paper board 100 in the vertical direction.

The spring 400 employs a wire-bound spring, and is coupled with the spring insertion holes (151 of FIG. 6) provided at the center of the connection portion between the upper laminated paper pieces, obtained by dividing the double type laminated paper board 100 by the first and third folded parts 114 and 124, in the vertical direction. One side of each of the plurality of calendar inner paper sheets 300 is connected to the spring 400.

Consequently, the lower end of the double type laminated paper board 100 is inserted into a designated pitch of the plural pitches of the spring 400 under the condition that the double type laminated paper board 100 is continuously folded at designated folded angles by the first and third folded parts 114 and 124 and the second and fourth folded parts 115 and 125, thereby completing the desk calendar with an adjustable tilt angle.

The calendar inner paper sheets 300 have a size which is equal to or smaller than the size (width×length) of the left front plate 111 or the right front plate 121 of the front plates 111 and 121. The left front plate 111 and the right front plate 121 serve to support the calendar inner paper sheet 300 when the calendar inner paper sheet 300 is turned over in the rightward or leftward directions.

The bottom plates 112 and 122 serve to support the front plates 111 and 121 and the rear plates 113 and 123, as shown in the structure of FIG. 1.

The rear plates 113 and 123 serve to support the front plates 111 and 121 so that the front plates 111 and 121 stand at a designated tilt angle, and serve to adjust the tilt angle of the front plates 111 and 121.

Figure 3:
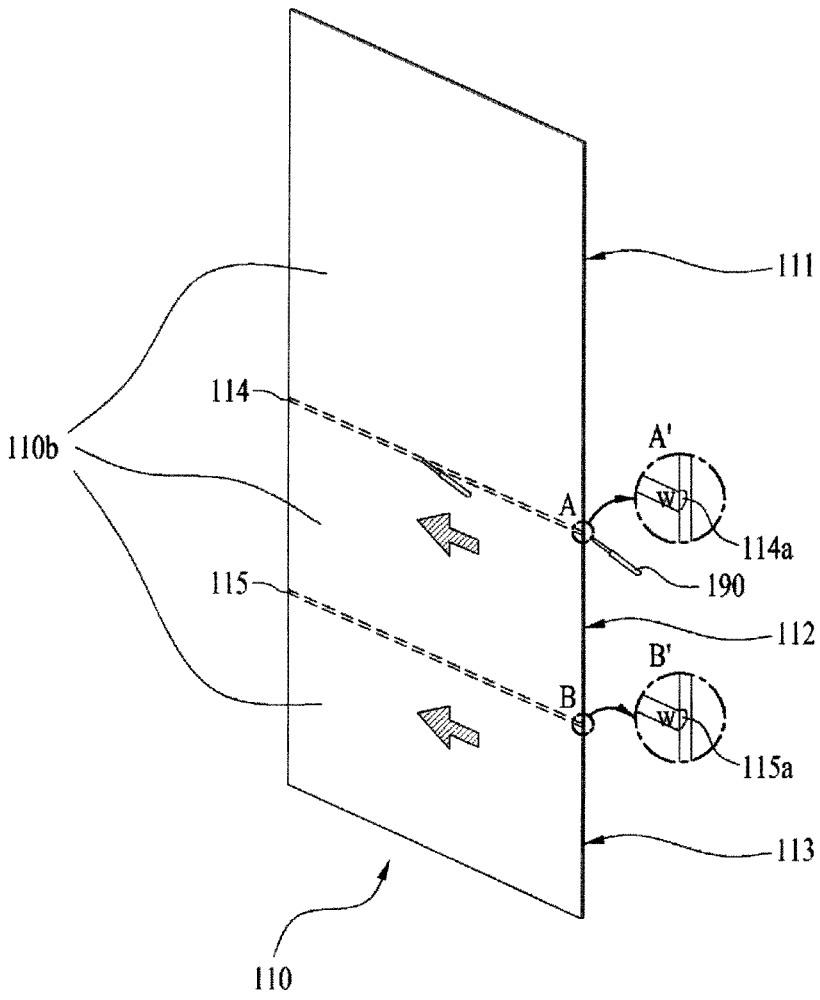
FIG. 3 is a perspective view illustrating a configuration of a first laminated paper piece in accordance with the present invention.
Figure 4:
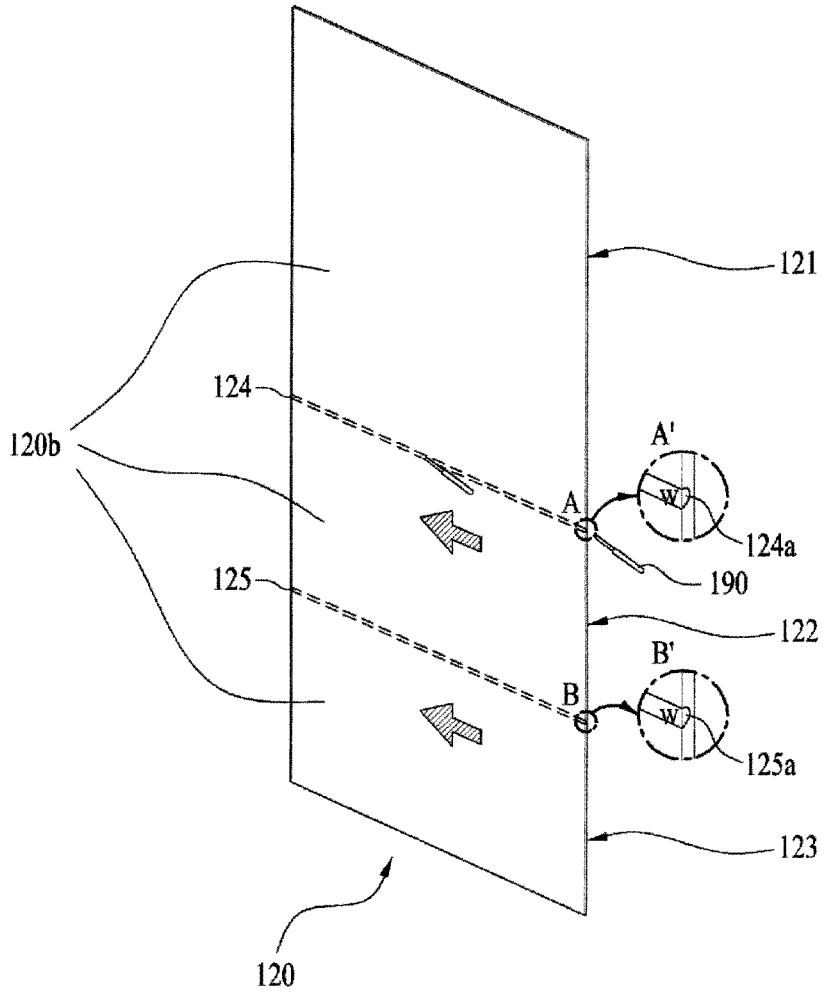
FIG. 4 is a perspective view illustrating a configuration of a second laminated paper piece in accordance with the present invention.

FIG. 3 is a perspective view illustrating a configuration of the first laminated paper piece 110 in accordance with the present invention, and FIG. 4 is a perspective view illustrating a configuration of the second laminated paper piece 120 in accordance with the present invention.

The first folded part 114 in accordance with the present invention forms a boundary line between the left front plate 111 and the left bottom plate 112 by forming a first folding groove 114*a* at a position A, located two-fourths of the way from the upper end of the rectangular first laminated paper piece 110 in the lengthwise direction, on the rear surface of the rectangular first laminated paper piece 110 in the horizontal direction. The left bottom plate 112 is folded at a folded angle of 20~179° in the rearward direction by the first groove 114*a* to form the first folded part 114.

Here, the first groove 114*a* having a semi-circular cross-section is depressed so as to have a width of 0.1~0.5 mm and a depth of 0.1~0.4 mm, as shown in FIG. 3.

The second folded part 115 in accordance with the present invention forms a boundary line between the left bottom plate 112 and the left rear plate 113 by forming a second folding groove 115*a* at a position B, located three-fourths of the way from the upper end of the rectangular first laminated paper piece 110 in the lengthwise direction, on the rear surface of the rectangular first laminated paper piece 110 in the horizontal direction. The left rear plate 113 is folded at a folded angle of 20~179° in the direction of the spring by the second groove 115*a* to form the second folded part 115.

Here, the second groove 115*a* having a semi-circular cross-section is depressed so as to have a width of 0.1~0.5 mm and a depth of 0.1~0.4 mm, as shown in FIG. 3.

The reason why the first groove 114*a* and the second groove 115*a* have the width of 0.1~0.5 mm is that, if the first groove 114*a* and the second groove 115*a* have a width of more than 0.5 mm, bonding force at connection portions between the first laminated paper piece 110 and the cover sheet 220 is lowered and thus the connection portions are easily torn and cracked when the first laminated paper piece 110 is used for a long time.

Further, the reason why the first groove 114*a* and the second groove 115*a* have the depth of 0.1~0.4 mm is that, if the first groove 114*a* and the second groove 115*a* have a depth of more than 0.4 mm, the front plates 111 and 121 and the bottom plates 112 and 122 are completely separated from each other.

Figure 9A:
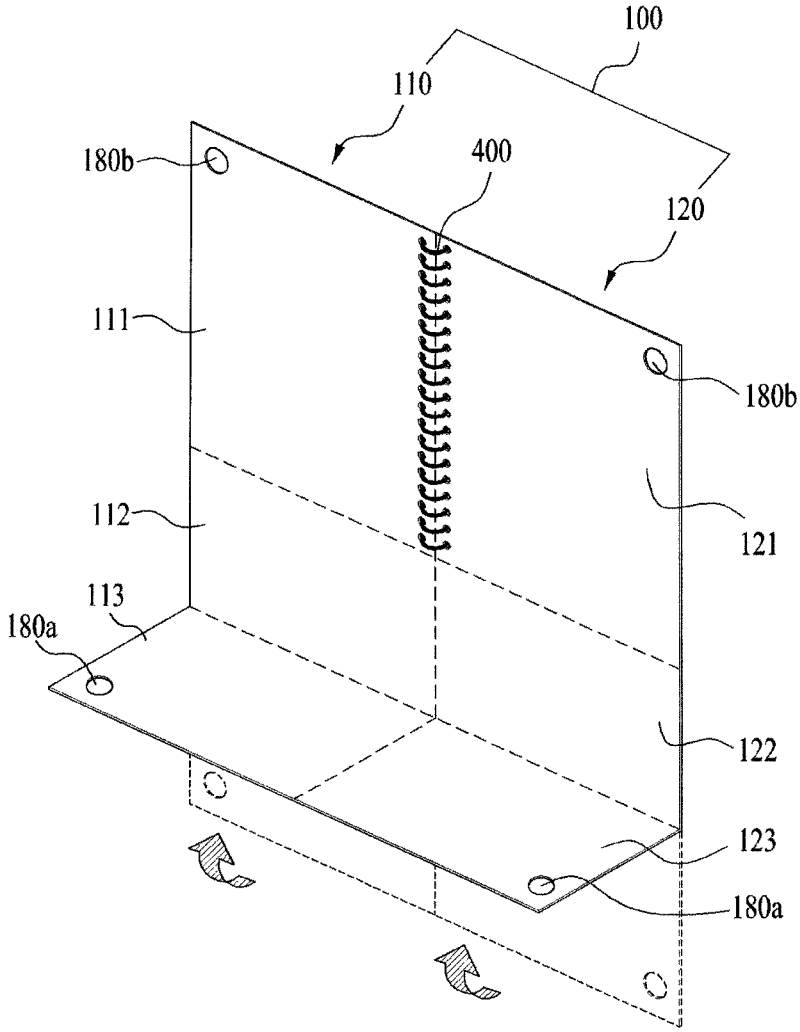
FIGS. 9A and 9B are perspective views exemplarily illustrating a process of forming bottom plates by folding the double type laminated paper board in accordance with the present invention in the rearward direction.
Figure 9B:
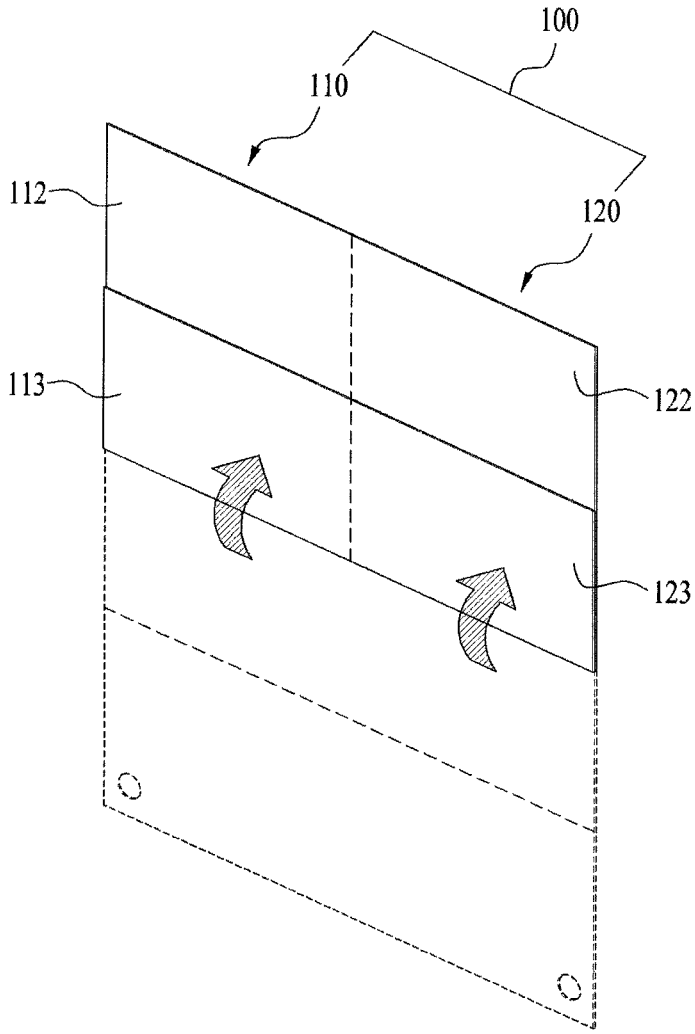

Further, the first groove 114*a*, which is formed in the semi-circular shape, reduces friction applied to portions folded by a folding operation. Therefore, the first groove 114*a* prevents the first laminated paper piece 110 from being easily torn and cracked although it is used for a long time. Further, in the present invention, as shown in FIGS. 9A and 9B, first magnetic parts 180*b* are provided at the edge of the upper end of the left front plate 111 and the edge of the upper end of the right front plate 121, and second magnetic parts 180*a* pairing with the first magnetic parts 180*b* are provided at the edge of the lower end of the left rear plate 113 and the edge of the lower end of the right rear plate 123.

The second laminated paper piece 120 is formed in a rectangular shape to support the calendar inner paper sheets 300 at the right side, and is connected with the first laminated paper piece 110 in parallel in the lengthwise direction through the cover sheet 200 adhered to the first and second laminated paper pieces 110 and 120.

The first laminated paper piece 110 and the second laminated paper piece 120 are connected through the cover sheet 200, thereby forming the above-mentioned front plates 111 and 121, bottom plates 112 and 122, and rear plates 113 and 123. The front plates 111 and 121, the bottom plates 112 and 122, and the rear plates 113 and 123 are divided into the left plates 111, 112, and 113 and the right plates 121, 122, and 123 by the folded part corresponding to the connection portion between the first laminated paper piece 110 and the second laminated paper piece 120.

The third folded part 124 in accordance with the present invention forms a boundary line between the right front plate 121 and the right bottom plate 122 by forming a third folding groove 124*a* at a position A, located two-fourths of the way from the upper end of the rectangular second laminated paper piece 120 in the lengthwise direction, on the rear surface of the rectangular second laminated paper piece 120 in the horizontal direction. The right bottom plate 122 is folded at a folded angle of 20~179° in the rearward direction by the third groove 124*a* to form the third folded part 124.

Here, the third groove 124*a* having a semi-circular cross-section is depressed so as to have a width of 0.1~0.5 mm and a depth of 0.1~0.4 mm, as shown in FIG. 4.

The fourth folded part 125 in accordance with the present invention forms a boundary line between the right bottom plate 122 and the right rear plate 123 by forming a fourth folding groove 125*a* at a position B, located three-fourths of the way from the upper end of the rectangular second laminated paper piece 120 in the lengthwise direction, on the rear surface of the rectangular second laminated paper piece 120 in the horizontal direction. The right rear plate 123 is folded at a folded angle of 20~179° in the direction of the spring by the fourth groove 125*a* to form the fourth folded part 125.

Here, the fourth groove 125*a* having a semi-circular cross-section is depressed so as to have a width of 0.1~0.5 mm and a depth of 0.1~0.4 mm, as shown in FIG. 4.

Figure 5:
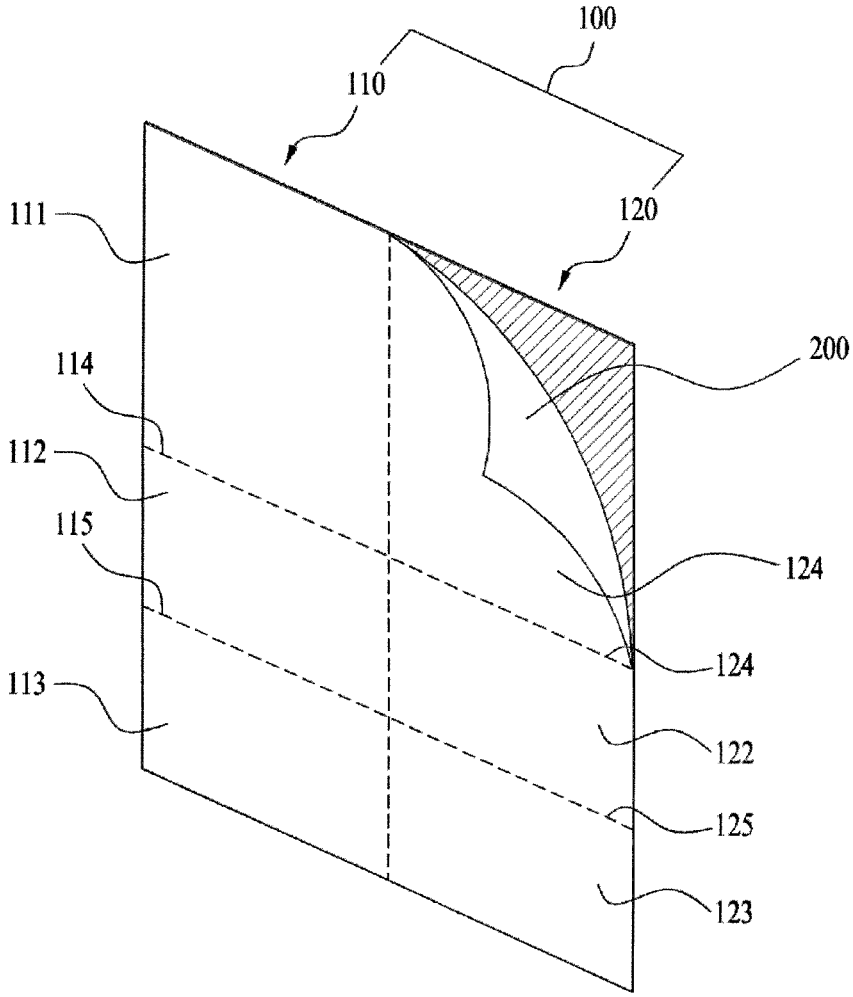
FIG. 5 is a perspective view exemplarily illustrating connection of the first laminated paper piece and the second laminated paper piece in accordance with the present invention.

FIG. 5 is a perspective view exemplarily illustrating connection of the first laminated paper piece and the second laminated paper piece in accordance with the present invention.

The left front plate 111 of the first laminated paper piece 110 and the right front plate 121 of the second laminated paper piece 120 in accordance with the present invention are connected in parallel by the cover sheet 200, as shown in FIG. 5.

Further, the left bottom plate 112 of the first laminated paper piece 110 and the right bottom plate 122 of the second laminated paper piece 120 are connected in parallel by the cover sheet 200, thus forming the bottom of the double-sided desk calendar.

Moreover, the left rear plate 113 of the first laminated paper piece 110 and the right rear plate 123 of the second laminated paper piece 120 are connected in parallel by the cover sheet 200, thus supporting the front plates 111 and 121 of the double-sided desk calendar.

Next, the cover sheet 200 in accordance with the present invention will be described.

The cover sheet 200 covers the rear surface and the front surface of the double type laminated paper board 100, on which the calendar inner paper sheets 300 are located, thereby preventing the plural folded parts of the double type laminated paper board 100 from cracking.

The cover sheet 200 is formed by applying a tough material to the surface of a paper member, a fabric member, or a vinyl member having a small thickness, and has excellent water resistance, tensile strength, tearing strength, and bursting strength.

An adhesive agent used to adhere the cover sheet 200 in accordance with the present invention to the front surface or the rear surface of the double type laminated paper board 100 has a composition including 15~39.5 wt % of vinyl acetate monomer (VAM), 0.1~8 wt % of ethylene, 0.1~8 wt % of acryl, and 60~75 wt % of water.

If the amount of VAM, which is a main ingredient of the adhesive agent, is below 15 wt %, adhesiveness of the adhesive agent is lowered, and if the amount of VAM exceeds 39.5 wt %, viscosity variation of the adhesive agent according to temperature is severe and it is difficult to stably use the adhesive agent. Therefore, the amount of VAM is preferably in the range of 15~39.5 wt %.

Ethylene and acryl are used to form a copolymer with VAM to increase adhesion strength of the adhesive agent. If the amount of each of ethylene and acryl is below 0.1 wt %, it is difficult to expect an increase of adhesion strength of the adhesive agent, and if the amount of each of ethylene and acryl exceeds 8 wt %, the amount of VAM is relatively reduced and thus adhesiveness of the adhesive agent is lowered. Therefore, the amount of each of ethylene and acryl is preferably in the range of 0.1~8 wt %.

Water is used as a solvent for the adhesive agent. If the amount of water is below 60 wt %, viscosity of the adhesive agent is excessively high and thus use of the adhesive agent is not easy, and if the amount of water exceeds 75 wt %, viscosity of the adhesive agent is lowered and flowability of the adhesive agent is excessively high and thus use of the adhesive agent is not easy. Therefore, the amount of water is preferably in the range of 60~75 wt %.

The adhesive agent is manufactured by slowly mixing 15~39.5 wt % of VAM, 0.1~8 wt % of ethylene, 0.1~8 wt % of acryl, and potassium persulfate (KPS) serving as an initiator with 60~75 wt % of water and then maturing the mixture at a temperature of 72~75° C. for 30~40 minutes.

In more detail, as the adhesive agent used to adhere the cover sheet 200 to the double type laminated paper board 100, a composition including 29.5 wt % of VAM, 5 wt % of ethylene, 5 wt % of acryl, and 60.5 wt % of water is used.

Further, in the present invention, in addition to the cover sheet 200, a paper sheet having a thickness of 0.4~1.5 t is used to surround the rear surface and the front surface of the double type laminated paper board 100, on which the calendar inner paper sheets 300 are located, thereby smoothing the surface of the double type laminated paper board 100 and preventing the double type laminated paper board 100 from cracking at the several folded parts.

Hereinafter, a method for manufacturing a wire-bound product in accordance with the present invention will be described using the double-sided desk calendar as an example.

The method will be described with reference to FIGS. 6 to 13 as well as FIGS. 3 to 5.

Figure 7:
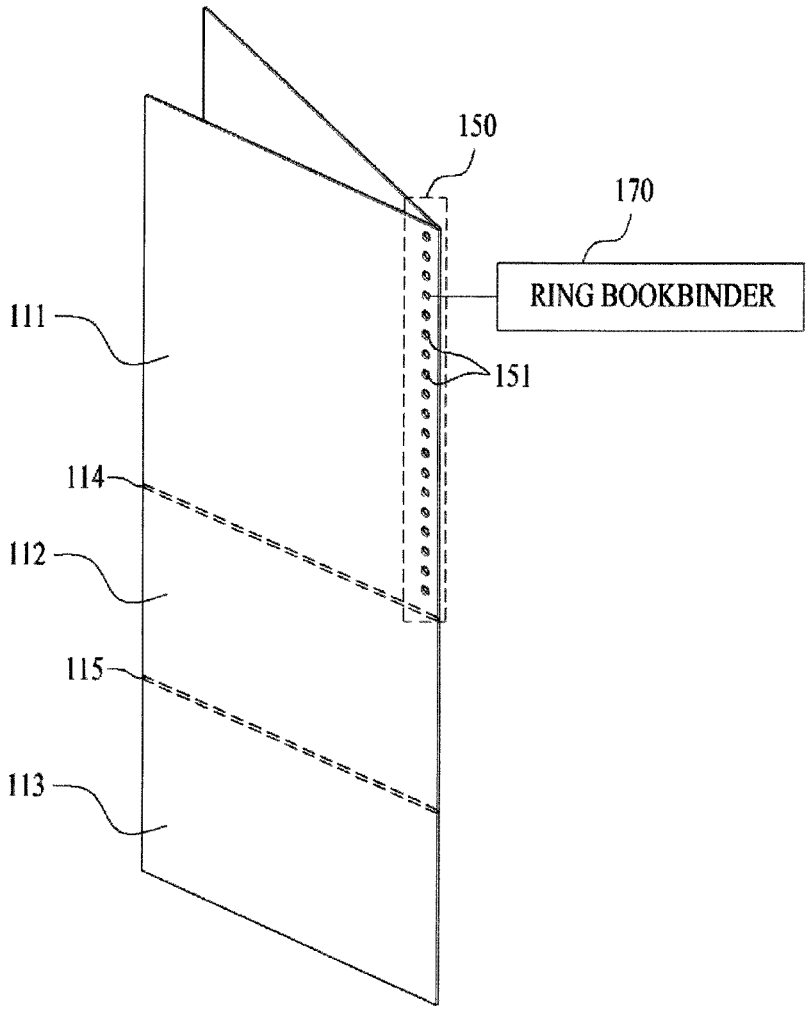
FIG. 7 is a perspective view exemplarily illustrating a process of automatically inserting a spring into the spring insertion holes in accordance with the present invention.

FIG. 6 is a perspective view exemplarily illustrating the spring insertion holes formed in parallel in the vertical direction through the double type laminated paper board in accordance with the present invention, and FIG. 7 is a perspective view exemplarily illustrating a process of automatically inserting the spring into the spring insertion holes in accordance with the present invention.

Figure 8:
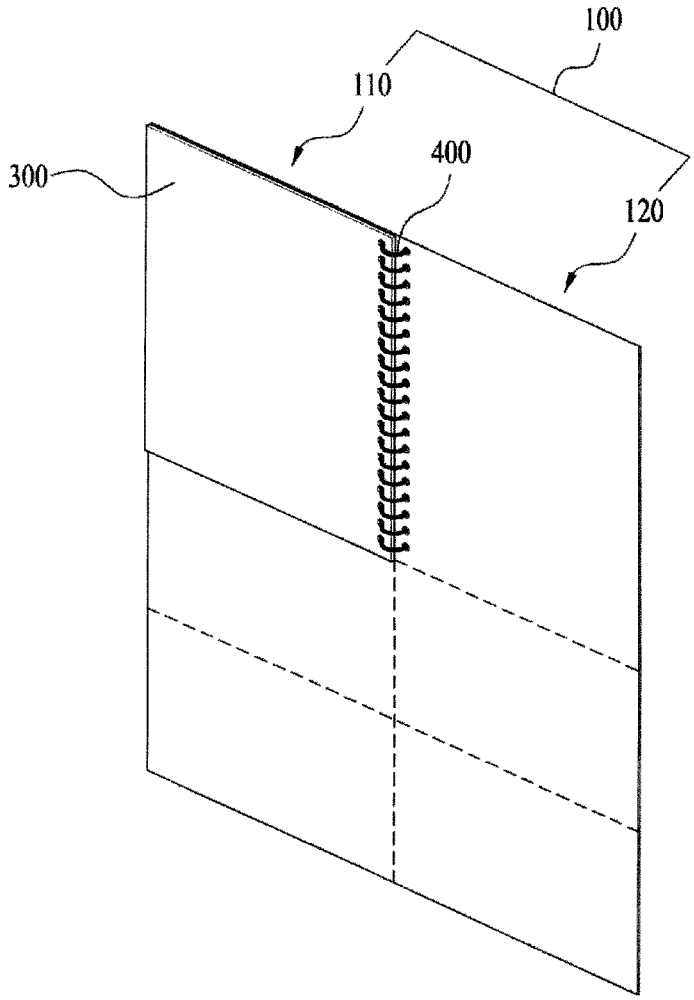
FIG. 8 is a perspective view exemplarily illustrating a process of connecting a plurality of inner paper sheets to the spring in accordance with the present invention.

FIG. 8 is a perspective view exemplarily illustrating a process of connecting the plurality of inner paper sheets to the spring in accordance with the present invention.

FIGS. 9A and 9B are perspective views exemplarily illustrating a process of forming the bottom plates by folding the double type laminated paper board in accordance with the present invention in the rearward direction.

Figure 10:
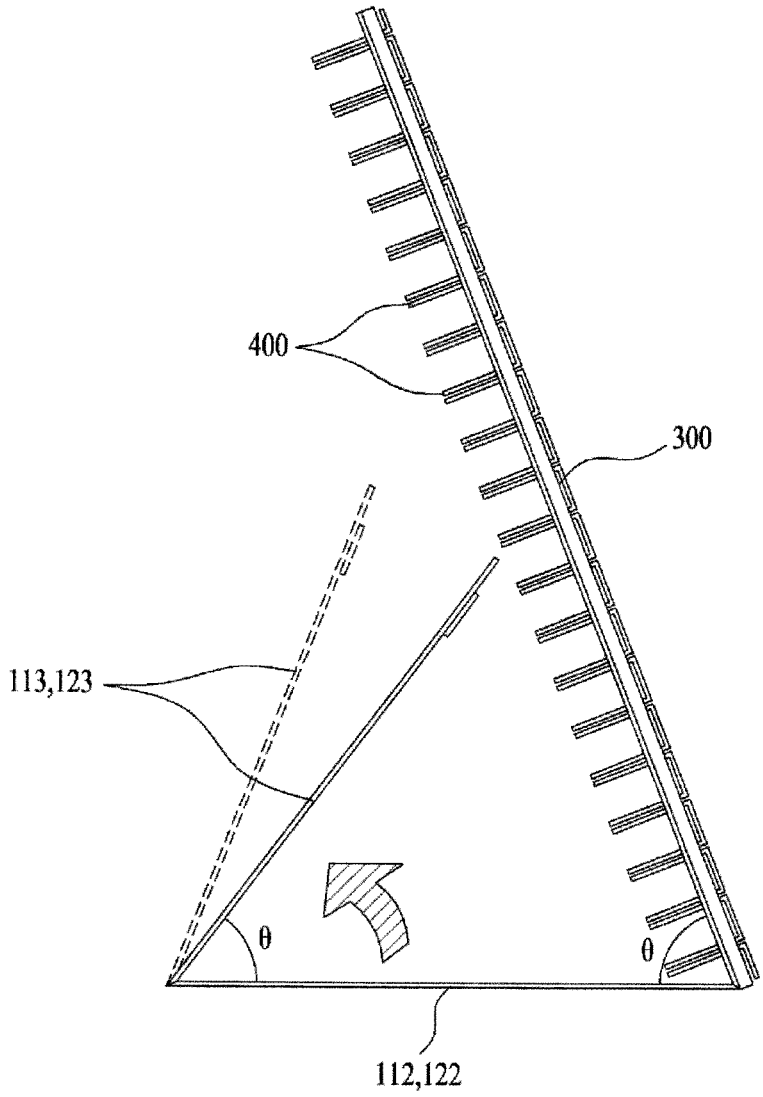
FIG. 10 is a side view exemplarily illustrating a process of forming rear plates by folding the double type laminated paper board in accordance with the present invention at a designated folded angle in the forward direction.

FIG. 10 is a side view exemplarily illustrating a process of forming the rear plates by folding the double type laminated paper board in accordance with the present invention at a designated folded angle in the forward direction.

Figure 11:
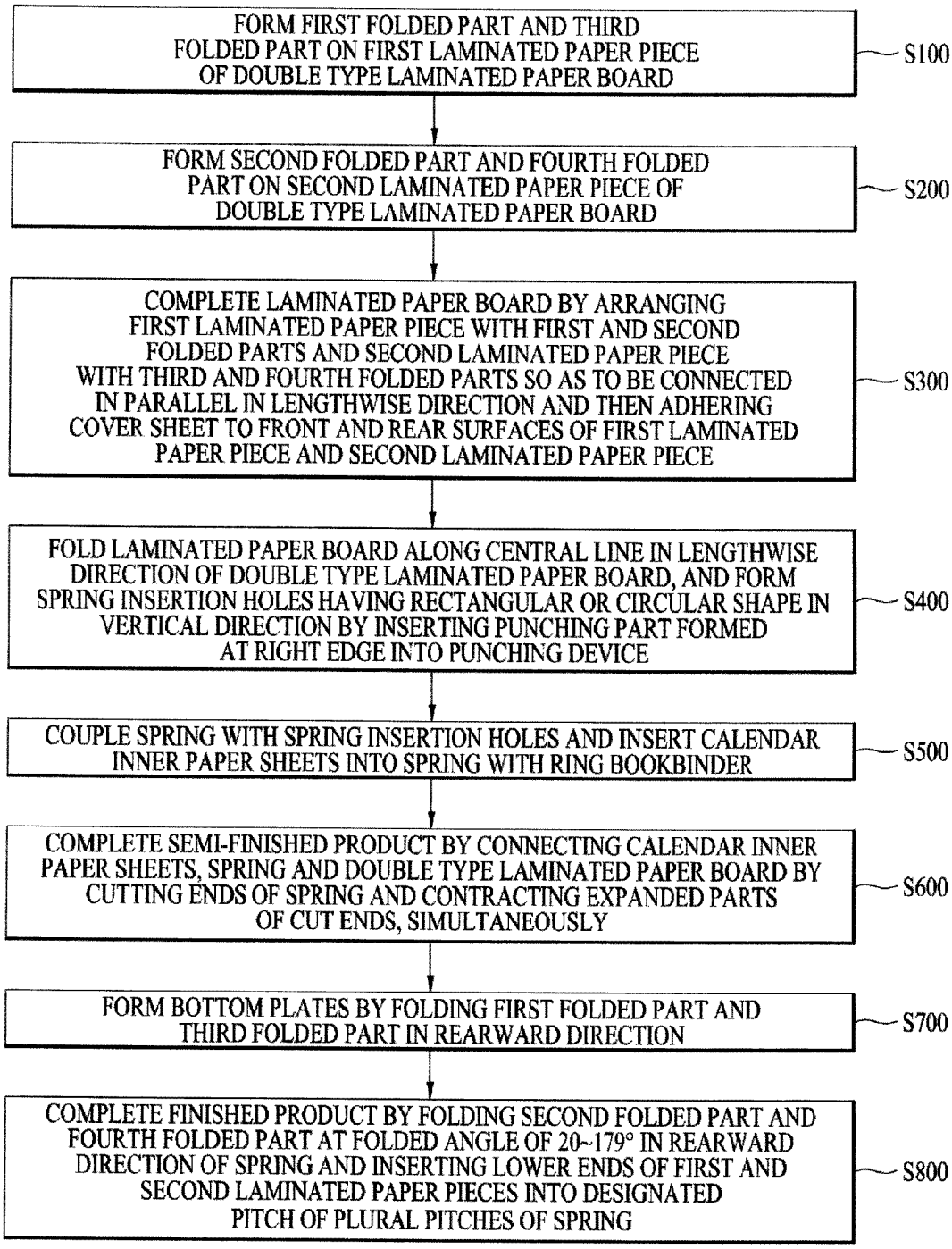
FIG. 11 is a flowchart illustrating a method for manufacturing a double-sided desk calendar with an adjustable tilt angle, at which front plates of a frame stand, in accordance with the present invention.
Figure 12:
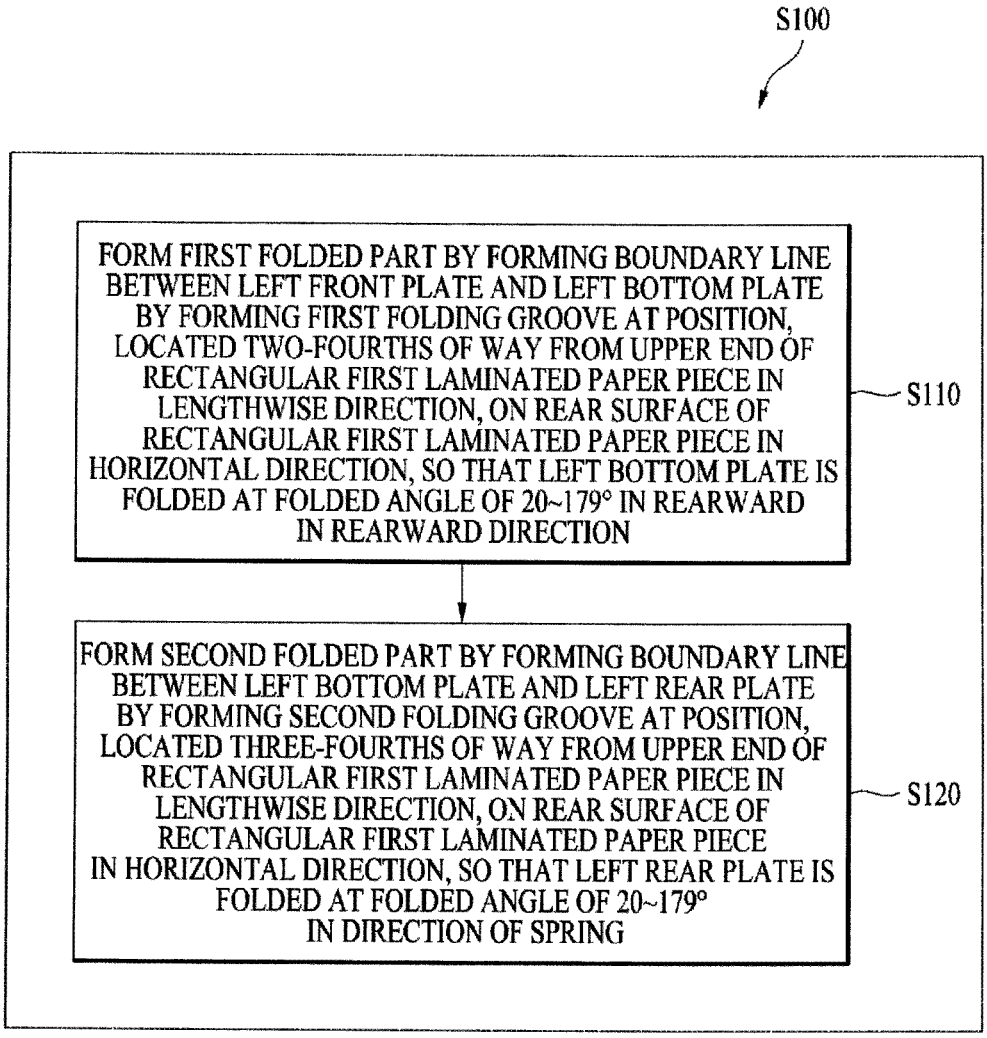
FIG. 12 is a flowchart illustrating a process of forming a first folded part and a second folded part on the first laminated paper piece in accordance with the present invention.
Figure 13:
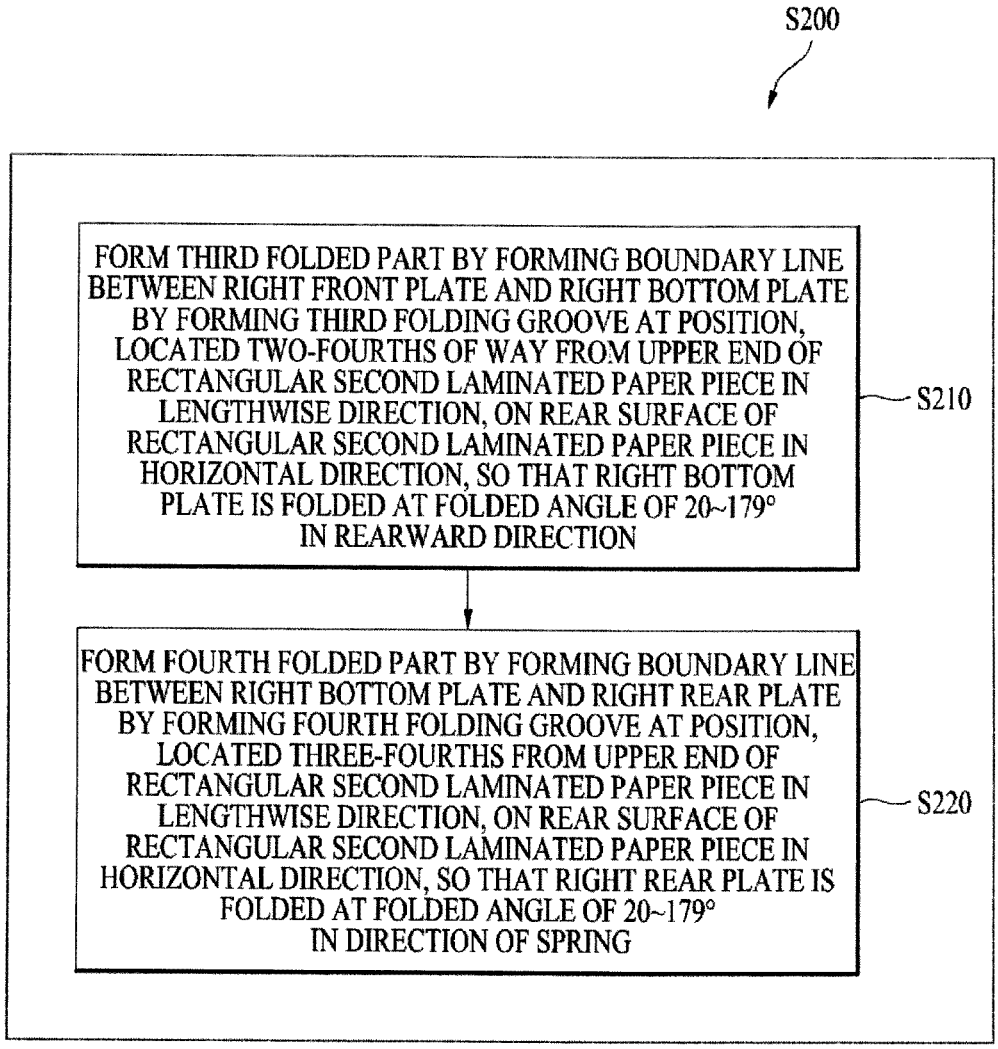
FIG. 13 is a flowchart illustrating a process of forming a third folded part and a fourth folded part on the second laminated paper piece in accordance with the present invention.

FIG. 11 is a flowchart illustrating a method for manufacturing the double-sided desk calendar with an adjustable tilt angle, at which front plates of a frame stand, in accordance with the present invention, FIG. 12 is a flowchart illustrating a process of forming the first folded part and the second folded part on the first laminated paper piece in accordance with the present invention, and FIG. 13 is a flowchart illustrating a process of forming the third folded part and the fourth folded part on the second laminated paper piece in accordance with the present invention.

First, the first folded part 114 and the second folded part 115 are formed on the first laminated paper piece 110 of the double type laminated paper board 100 in the horizontal direction (operation S100).

Formation of the first folded part 114 and the second folded part 115 includes formation of the first folded part 114 (operation 5110) and formation of the second folded part 115 (operation S120), as shown in FIG. 12.

In formation of the first folded part 114 (operation S110), as shown in FIG. 3, a boundary line between the left front plate 111 and the left bottom plate 112 is formed by forming the first folding groove 114*a* at a position, located two-fourths of the way from the upper end of the rectangular first laminated paper piece 110 in the lengthwise direction, on the rear surface of the rectangular first laminated paper piece 110 in the horizontal direction with a hole processing machine. Thereby, the left bottom plate 112 is folded at a folded angle of 20~179° in the rearward direction.

In formation of the second folded part 115 (operation S120), as shown in FIG. 3, a boundary line between the left bottom plate 112 and the left rear plate 113 is formed by forming the second folding groove 115*a* at a position, located three-fourths of the way from the upper end of the rectangular first laminated paper piece 110 in the lengthwise direction, on the rear surface of the rectangular first laminated paper piece 110 in the horizontal direction with the hole processing machine. Thereby, the left rear plate 113 is folded at a folded angle of 20~179° in the direction of the spring.

Thereafter, the third folded part 124 and the fourth folded part 125 are formed on the second laminated paper piece 120 of the double type laminated paper board 100 in the horizontal direction (operation S200).

Formation of the third folded part 124 and the second folded part 125 includes formation of the third folded part 124 (operation S210) and formation of the fourth folded part 125 (operation S220), as shown in FIG. 13.

In formation of the third folded part 124 (operation S210), as shown in FIG. 4, a boundary line between the right front plate 121 and the right bottom plate 122 is formed by forming the third folding groove 124*a* at a position, located two-fourths of the way from the upper end of the rectangular second laminated paper piece 120 in the lengthwise direction, on the rear surface of the rectangular second laminated paper piece 120 in the horizontal direction. Thereby, the right bottom plate 122 is folded at a folded angle of 20~179° in the rearward direction.

In formation of the fourth folded part 125 (operation S220), as shown in FIG. 4, a boundary line between the right bottom plate 122 and the right rear plate 123 is formed by forming the fourth folding groove 125*a* at a position, located three-fourths of the way from the upper end of the rectangular second laminated paper piece 120 in the lengthwise direction, on the rear surface of the rectangular second laminated paper piece 120 in the horizontal direction. Thereby, the right rear plate 123 is folded at a folded angle of 20~179° in the direction of the spring.

Thereafter, as shown in FIG. 5, the first laminated paper piece 110 provided with the first and second folded parts 114 and 115 and the second laminated paper piece 120 provided with the third and fourth folded parts 124 and 125 are arranged so as to be connected in parallel in the lengthwise direction, and then the cover sheet 200 is adhered to the front and rear surfaces of the first laminated paper piece 110 and the second laminated paper piece 120, thereby completing the double type laminated paper board 100 (operation S300).

Here, side portions of the first laminated paper piece 110 and the second laminated paper piece 120 are arranged such that the first folded part 114 of the first laminated paper piece 110 and the third folded part 124 of the second laminated paper piece 120 run in parallel and the second folded part 115 of the first laminated paper piece 110 and the fourth folded part 125 of the second laminated paper piece 120 run in parallel, and then the cover sheet 200 is adhered to the front or rear surfaces of the first laminated paper piece 110 and the second laminated paper piece 120, thereby completing the double type laminated paper board 100. As the adhesive agent used to adhere the cover sheet 200 to the first laminated paper piece 110 and the second laminated paper piece 120, a composition including 29.5 wt % of vinyl acetate monomer (VAM), 5 wt % of ethylene, 5 wt % of acryl, and 60.5 wt % of water is used.

Thereafter, as shown in FIG. 6, the double type laminated paper board 100 is folded along the central line in the lengthwise direction of the double type laminated paper board 100 corresponding to the connection portion between the first laminated paper piece 110 and the second laminated paper piece 120, and then the spring insertion holes 151 having a rectangular or circular shape are formed in parallel in the vertical direction by inserting a punching part 150 formed at the right edge of the folded double type laminated paper board 100 into a punching device 160 (operation S400). Here, the double type laminated paper board 100 is folded in one direction along the connection portion between the first laminated paper piece 110 and the second laminated paper piece 120, and then the spring insertion holes 151 are formed in parallel in the vertical direction by inserting the punching part 150 adjacent to the folded part into the punching device 160.

Here, the punching device 160 serves to form the spring insertion holes 151 having a rectangular or circular shape.

Thereafter, as shown in FIG. 7, the spring 400 is coupled with the spring insertion holes 151 formed along the central line in the lengthwise direction between the first laminated paper piece 110 and the second laminated paper piece 120 and the plural calendar inner paper sheets 300 are automatically inserted into the spring 400 using a ring bookbinder 170 on which the spring 400 is mounted (operation S500).

Here, the ring bookbinder 170 on which the ring bookbinder 170 is mounted is a device to automatically insert the calendar inner paper sheets 300 into the spring 400.

Thereafter, as shown in FIG. 8, the calendar inner paper sheets 300, the spring 400, and the double type laminated paper board 100 are connected by cutting ends of the spring 400 coupled with the spring insertion holes 151 by the ring bookbinder 170, on which the spring 400 is mounted, and contracting expanded parts of the cut ends of the spring 400, simultaneously, thereby completing a semi-finished product for the double-sided desk calendar (operation S600). Here, the semi-finished product for the double-sided desk calendar indicates a state prior to formation of a finished product for the double-sided desk calendar, which can stand, obtained through plural folding operations, as shown in FIG. 1, and includes all components of the double-sided desk calendar.

Here, the ends of the spring 400 are cut using a cutting machine.

Thereafter, as shown in FIG. 9, the first folded part 114 and the third folded part 125 of the double type laminated paper board 100 are folded in the rearward direction of the semi-finished product, thereby forming the bottom plates 112 and 122 (operation S700). Here, it is understood that the bottom plates 112 and 122 include the rear plates 113 and 123.

Finally, as shown in FIG. 10, the second folded part 115 and the fourth folded part 125 of the double type laminated paper board 100 are folded at an angle of 20~179° in the rearward direction of the spring 400, and then the rear plates 113 and 123 are inserted into a designated pitch of a plurality of pitches of the spring 400. Thereby, manufacturing of the finished product for the double-sided desk calendar is completed (operation S800).

Thereby, an eye level of the double-sided desk calendar is adjusted according to user's taste, and individual calendar inner paper sheets are turned over in the rightward and leftward directions, thereby allowing advertisements to be printed on both surface of the double-sided desk calendar.

As apparent from the above description, a wire-bound product and a method for manufacturing the same in accordance with the present invention have several effects, as follows.

In the conventional structure in which a plurality of inner paper sheets is turned over toward the rear surface of a frame, only one surface of each of the inner paper sheets is visible in one direction. On the other hand, the wire-bound product in accordance with the present invention employs a structure in which inner paper sheets are turned over in the rightward and leftward directions on front plates of a frame, thereby allowing a user to see both surfaces of the inner paper sheets. Accordingly, advertisements on both surfaces of the inner paper sheets are possible.

Further, in the conventional structure in which a front plate and a rear plate are fixed in a triangular shape, a standing angle of the front plate is not adjustable. On the other hand, the wire-bound product in accordance with the present invention employs a structure in which rear plates supporting the front plates can be inserted into various positions of a spring, thereby allowing a standing angle of the front plates of the frame to be adjustable. Accordingly, the standing angle of the front plates is adjusted to an eye level according to user's taste.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A wire-bound product comprising:

a laminated paper board including a first laminated paper piece with first and second folded parts provided in the horizontal direction, a second laminated paper piece with third and fourth folded parts provided in the horizontal direction in parallel with the first and second folded parts, and spring insertion holes provided through a part of the upper region of a connection portion between the first and second laminated paper pieces in the vertical direction;

a spring coupled with the spring insertion holes;

paper sheets, each of which is provided with one side connected to the spring, rotated rightward and leftward about the spring;

first magnetic parts provided at an edge of an upper end of the upper laminated paper pieces of the first laminated paper pieces and at an edge of an upper end of the upper laminated paper pieces of the second laminated paper pieces; and second magnetic parts pairing the first magnetic parts provided at an edge of a lower end of the second lower laminated paper pieces of the first laminated paper pieces and at an edge of a lower end of the second lower laminated paper pieces of the second laminated paper pieces, wherein:

the first and second laminated paper pieces of the laminated paper board are divided into upper laminated paper pieces with the spring and lower laminated paper pieces with the second and fourth folded parts by the first and third folded parts running in parallel, and the lower laminated paper pieces are divided into first lower laminated paper pieces and second lower laminated paper pieces by the second and fourth folded parts running in parallel;

as the laminated paper board is folded at a designated first folded angle by the first and third folded parts and is then folded at a designated second folded angle by the second and fourth folded parts; and the second lower laminated paper pieces have lower ends corresponding to a lower end of the laminated paper board and being inserted into a designated pitch of a plurality of pitches of the spring.

2. The wire-bound product according to claim 1, wherein a cover sheet made of paper, fabric, or vinyl is adhered to one surface of the laminated paper board.

3. The wire-bound product according to claim 1, wherein, as the lower ends of the second lower laminated paper pieces are inserted into the designated pitch of the plurality of pitches of the spring, the first lower laminated paper pieces correspond to bottom plates of the wire-bound product, the upper laminated paper pieces correspond to front plates of the wire-bound product, and the second lower laminated paper pieces correspond to rear plates of the wire-bound product.

4. The wire-bound product according to claim 3, wherein, as the lower ends of the second lower laminated paper pieces are inserted into a different pitch of the plurality of pitches of the spring, the front plates have a different tilt angle with respect to the bottom plates.

5. The wire-bound product according to claim 1, wherein the first and second folded angles are 20~179° in the rearward direction with respect to the upper laminated paper pieces and the first lower laminated paper pieces, respectively.

* * * * *